US007295491B2

(12) United States Patent
Carstensen

(10) Patent No.: US 7,295,491 B2
(45) Date of Patent: Nov. 13, 2007

(54) HIGH IMPACT COMMUNICATION AND CONTROL SYSTEM

(76) Inventor: Kenneth J. Carstensen, 1860 Whiteoak Dr., Apt. 211, Houston, TX (US) 77009

( * ) Notice: Subject to any disclaimer, the term of this patent is extended or adjusted under 35 U.S.C. 154(b) by 459 days.

(21) Appl. No.: 10/882,195

(22) Filed: Jul. 2, 2004

(65) Prior Publication Data

US 2004/0238184 A1 Dec. 2, 2004

Related U.S. Application Data

(60) Continuation of application No. 10/141,867, filed on May 10, 2002, now Pat. No. 6,760,275, which is a division of application No. 09/056,055, filed on Apr. 6, 1998, now Pat. No. 6,388,577.

(60) Provisional application No. 60/042,783, filed on Apr. 7, 1997.

(51) Int. Cl.
*G01V 3/00* (2006.01)

(52) U.S. Cl. ..... 367/83; 340/854.3; 340/853.1; 340/854.1

(58) Field of Classification Search ..... 181/106; 367/144, 99; 340/854.3
See application file for complete search history.

(56) References Cited

U.S. PATENT DOCUMENTS

| | | | |
|---|---|---|---|
| 2,924,432 | A | 2/1960 | Arps et al. |
| 3,227,228 | A | 1/1966 | Bannister |
| 3,316,997 | A | 5/1967 | McCoy |
| 3,613,070 | A | 10/1971 | Jones et al. |
| 3,622,962 | A | 11/1971 | Wingel et al. |
| 3,708,990 | A | 1/1973 | Crooke |
| 3,732,728 | A | 5/1973 | Fitzpatrick |
| 3,739,845 | A | 6/1973 | Berry et al. |
| 3,780,809 | A | 12/1973 | Ayers, Jr. et al. |
| 3,915,256 | A | 10/1975 | McCoy |
| 3,961,308 | A | 6/1976 | Parker |
| 3,965,983 | A | 6/1976 | Watson |
| 4,038,632 | A | 7/1977 | Parker |
| 4,063,215 | A | 12/1977 | Abbott |

(Continued)

FOREIGN PATENT DOCUMENTS

| | | |
|---|---|---|
| EP | 0 672 819 | 9/1995 |

(Continued)

*Primary Examiner*—Albert K. Wong
(74) *Attorney, Agent, or Firm*—Jones, Tullar & Cooper, PC; Raymond A. Bogucki

(57) ABSTRACT

A system and method in accordance with the invention communicator remotely with remotely controllable down hole tools in a well bore at a drilling installation. At the surface, high energy pressure impulses directed into the tubing or the annulus, or both, being at a level to propagate through an interface between very different impedances zones, such as an upper level gas zone and a lower level of mobile fluid media extending down into the desired down-hole location. The pressure impulses, provided by directionally gating along the longitudinal confining path a pressure impulse initially having sharp leading and trailing edges, reach the downhole location as physical perturbations forming a discernible pattern that can be detected by one or more energy responsive transducers. With combinations of these signals, one of a number of separate control devices can be remotely actuated. The system avoids the need for physical or electrical connections and concurrently greatly reduces the likelihood of accidental operation.

3 Claims, 8 Drawing Sheets

U.S. PATENT DOCUMENTS 4,065,747 A 12/1977 Patten et al.
4,073,341 A 2/1978 Parker
4,206,810 A 6/1980 Blackman
4,243,979 A * 1/1981 Kleinschmidt ..... 340/554
4,445,389 A 5/1984 Potzick et al.
4,637,463 A 1/1987 McCoy
4,646,871 A * 3/1987 Wolf ..... 181/106
4,713,800 A * 12/1987 Russell ..... 367/144
4,722,393 A 2/1988 Rumbaugh
4,781,607 A 11/1988 Rumbaugh
4,796,699 A 1/1989 Upchurch
4,856,595 A 8/1989 Upchurch
4,862,426 A 8/1989 Cassity et al.
4,871,045 A 10/1989 Cole
4,908,804 A 3/1990 Rorden
4,915,168 A 4/1990 Upchurch
4,945,761 A 8/1990 Lessi et al.
4,971,160 A 11/1990 Upchurch
5,018,115 A * 5/1991 Pascouet ..... 367/144
5,050,675 A 9/1991 Upchurch
5,117,399 A * 5/1992 McCoy et al. ..... 367/99
5,188,183 A 2/1993 Hopmann et al.
5,214,251 A 5/1993 Orban et al.
5,226,494 A 7/1993 Rubbo et al.
5,273,112 A 12/1993 Schultz
5,283,768 A 2/1994 Rorden
5,285,388 A 2/1994 McCoy et al.
5,313,025 A 5/1994 Roessler et al.
5,343,963 A 9/1994 Bouldin et al.
5,358,035 A 10/1994 Grudzinski
5,375,098 A 12/1994 Malone et al.
5,412,568 A 5/1995 Schultz
5,458,200 A 10/1995 Lagerlef et al.
5,490,564 A 2/1996 Schultz et al.
5,535,177 A 7/1996 Chin et al.
5,558,153 A 9/1996 Holcombe et al.
5,568,448 A 10/1996 Tanigushi et al.
5,579,283 A 11/1996 Owens et al.
5,611,401 A 3/1997 Myers, Jr. et al.
5,646,910 A * 7/1997 Bouyoucos ..... 367/144
5,691,712 A 11/1997 Meek et al.
5,834,710 A * 11/1998 Finnestad ..... 181/106
5,995,449 A 11/1999 Green et al.

FOREIGN PATENT DOCUMENTS

GB 2 281 424 4/1998

* cited by examiner

HIGH IMPACT COMMUNICATION AND CONTROL SYSTEM

CROSS-REFERENCE TO RELATED APPLICATIONS

This invention relates to Provisional Application Ser. No. 60/042,783, filed Apr. 7, 1997. The contents of that application are incorporated by reference herein. This application is a continuation of a prior application of Kenneth J. Carstensen, application Ser. No. 10/141,867 filed May 10, 2002, now U.S. Pat. No. 6,760,275. That patent is a division of a prior application of Kenneth J. Carstensen, application Ser. No. 09/056,055 filed Apr. 6, 1998, now U.S. Pat. No. 6,388,577. That patent claims priority to the above-identified provisional patent application.

FIELD OF THE INVENTION

This invention relates to systems and methods for remote actuation or control of tools and completion equipment in gas and oil wells, whether in subsurface or subsea locations, for communication and control in measurement while drilling (MWD) systems and associated tools, and for remote control of traveling bodies and stationary elements in pipeline installations.

BACKGROUND OF THE INVENTION

As oil and gas drilling and production techniques have advanced and become more complex and versatile, many different down-hole tools have come into use. Some include their own power packs, or other energy sources, and either are or can potentially be operated by remote control. Microprocessors, which are small, reliable and have a low power consumption, are commonly used in such tools and equipment. There are many other potential applications for remote control of tools and other equipment within a confining passageway at a substantial distance, including not only in the drilling, completion, workover, production and abandonment of a well, but also in tools and devices that are fixed or movable in pipelines and further with underwater equipment connected to a surface system via a subsea manifold. If commands can reliably be communicated to a remote well bore location, then such functions as opening and closing valves, sliding sleeves, inflating plugs, detonating perforating guns, shifting tools and setting packers are available. Through the use of remote actuation, expensive down time in the well can be minimized, saving the costs of many hours or even days of operation.

Systems have been proposed, and some are in use, for remote control of equipment in well bore installations. A wire connection system using electric line has been in use for some time, and remains in use today. This system employs a heavy duty electrical line that is fed into the well bore along the tubing or casing string to the down-hole location. The line is of relatively large diameter and for setup requires a massive carrier and support equipment, with setup time requiring many hours. Moreover, electrical power transmitted into a deep well creates potential dangers from short circuits and arcing in explosive environments at the well site where an inert atmosphere cannot be maintained. A later developed "Slickline" is only a wire for providing mechanical operations and is of much smaller diameter although very high strength. While it can be transported and manipulated by much smaller vehicles and installations, and is deployed considerably more rapidly than the electric line mechanism, it is not well suited to remote operation of down-hole tools. Time consuming and unsafe control methods with these systems are based on use of times, and motion sequences combined with, pressure and temperature readings.

Other systems are known for transmitting non-electrical commands to preinstalled down-hole tools by communicating through a pressurized liquid medium or metal walls along the well bore. Pressure variations imparted at the surface are sensed by a strain gauge or other transducer at the remote location, to trigger a battery powered device in response to a coded pressure varying signal. One such system, called the "EDGE" (trademark of Baker Hughes) system, interfaces with liquid media only and injects pulses of chosen frequency into the well bore. A down-hole tool having an actuable element powered at the tool includes electronic circuits which filter the selected frequency from other variations and respond to a selected pattern of pulse frequencies. This system requires substantial setup time and can only be used in a constant and predictable all-liquid bore. Another system effects control of mechanical devices by establishing a high initial pressure and then bleeding off pressure in a programmed fashion.

Another prior art system is disclosed in U.S. Pat. No. 3,227,228 (1966) assigned to Bannister. This patent teaches the use of a liquid injector to inject liquid into a liquid-filled well bore to create a pressure pulse. The pressure pulse travels down the liquid-filled tubing and is detected as it passes a pressure transducer projecting out into the fluid. The signal from the pressure transducer is used to actuate a downhole tool. As with the Baker "EDGE" system, the conduit through which the pulse is to be sent has to be completely filled with liquid for the system to work.

There is a need, therefore, for a remote control system and method which will function reliably in actuating a remote tool or other equipment, whatever the nature of the media in the confining elongated bore. Preferably, it should be useful in a wide range of well drilling and completion operations, including MWD, and in pipeline applications which are generally horizontal. The system and method should ensure against accidental triggering of the remote device and be essentially insensitive to extraneous operating conditions and effects. It should also be capable of remote control of selected individual ones of a number of different devices, and providing redundant modes of detection for enhanced reliability and communication capability. While retaining the higher degree of reliability, the system should preferably also require substantially less setup and operating time for field installation and actuation.

MWD installations currently in use require communication with bottom hole assembly (BHA) measuring equipment such as sensors, instruments and microprocessors. The MWD equipment stores information on many parameters including but not limited to bit direction, hole angle, formation evaluation, pressure, temperature, weight on bit, vibration and the like. This is transmitted to the surface using mud pulsing technology. Communicating to the MWD equipment for the purpose of controlling movable elements (i.e., to adjust the stabilizer blades to control direction) is, however, another matter, since not only must commands be given, they must actuate the proper tool and provide sufficient data to make a quantitative adjustment. The current methods use changes of pump rate, and changes of weight on the bit, both of which take time, are limited in data rate, and increase the chances of sticking the drill string.

Remote control of elements in pipelines is a significant objective, since pipeline pigs are driven downstream for inspection or cleaning purposes and can stick or malfunction. Some pigs include internal processor and control equipment while others are designed to disintegrate under particular conditions. The ability to deliver commands to a pig or a stationary device in a remote location in a pipeline is thus highly desirable.

SUMMARY OF THE INVENTION

Applicant has discovered and shown that a brief high amplitude pressure impulse will propagate into and through media of different types in a well bore. The pressure impulse transforms during propagation into a time-stretched waveform, at low frequency, that retains sufficient energy at great depth, so that the leading and trailing edges of its transformed profile are readily detectable by modern pressure and motion responsive instruments.

Systems and methods in accordance with the invention utilize a high energy, very short duration, pneumatic impulse transmitted into a tubular or annular system such as exists within a well bore or pipeline. Pressure at a selected level from a gas source is abruptly expelled from a chamber of chosen volume through an orifice into an entry zone, creating an impact burst reaching a very high peak amplitude. Preferably, the pressure level used for supplying pneumatic energy is in the range of 100 to 15,000 psi, the time needed to open into the orifice is of the order of a few milliseconds, and the pressure confining chamber is in the range of 2 to 200 $in^3$ in volume. This energy is dissipated substantially and differently during transmission through long paths in the media, or combination of media, that fills the tubular system. However, the pressure impulse transforms into an extended wavetrain having dominant frequency components, usually below about 200 Hz. Significantly, the pressure impulse traverses the interface between zones of different impedance, such as between a gas level above the top of liquid media in the well bore. Furthermore the impulse propagates without substantial attenuation within the tubular system or annulus, whatever the liquid media or mixture of media in the path. These are referred to herein as "mobile fluid media."

Since it is usually known whether the media is liquid, gas, or successive layers of the two, or contains particulates or other solids, and since well depth is known, the attenuation can be estimated and the energy impulse can be adjusted accordingly. In all instances, wave energy transformation during transmission follows a generic pattern. The pressure impulse is not only diminished in amplitude but is spread out in time, and the brief impulse transitions within the confining structure into what may be called a "tube wave" This is a sequence of high amplitude waves at a low frequency approximately determined by the diameter of the tubular confinement structure. These "tube waves", known and defined in seismic applications, contain ample acoustic wave energy at the deep down-hole location to generate signals of high signal-to-noise ratios.

The pressure variations derived from an input burst are typically of a fraction of a second in total duration. At the remote location one or more transducers respond to physical perturbations of the media to generate separate electrical signals for associated threshold detection, amplifier and decoding circuitry that can recognize signal coding sequences. The signal coding is in the form of a series of time distributed wavetrains above some threshold level, which series represents a binary data sequence. Detection is not frequency or duration based, although the communicated energy varies within frequency and time spaced limits. The components of each series are adequately separated in time to prevent ambiguity arising from possible overlap of the time spread sequences at down-hole targets. The control system circuitry then activates its local energy source to operate the tool selected by the coded sequence in the manner indicated.

The system and method thus imparts an initial high energy burst that assures that wave energy reaches the deep target location in the form of predictable pressure variations. The received signals are so modulated and distinct as to provide a suitable basis for redundant transmissions, ensuring reliability. The system is tolerant of the complex media variations that can exist along the path within the well bore. Differences in wave propagation speed, tube dimension, and energy attenuation do not preclude adequate sensitivity and discrimination from noise. Further, using adequate impulse energy and distributed detection schemes, signals can reach all parts of a deephole installation having multiple lateral bores.

In a pipeline installation, this method of imparting a high energy, impulse is particularly effective because with the uniform media in the pipeline an impulse can traverse a long distance. Thus, an instrumented or cleaning pig can be commanded from a remote source to initiate a chosen control action or pig disintegration.

The concept is particularly suitable for MWD applications, which include not only directional controls, but utilize other commands to modify the operation of down-hole units. The MWD context may require many more encoded patterns, in order to compensate for the dynamic variations that are encountered by the MWD equipment during operation.

The system is also applicable to subsea oil and gas production installations, which typically interconnect a surface platform or vessel via pipelines to a seafloor manifold system communicating with subterranean well bores. By impulsing at the surface with complex coded sequences, systems on the seafloor and down hole tools can be addressed and controlled via the pipelines.

Further in accordance with the invention, the sensor equipment at the remote location may comprise a pressure sensitive device such as a hydrophone, a strain sensor, motion sensitive devices such as a geophone or accelerometer, or a combination used in redundant and mutually supportive fashion. Accommodating the fact that the propagated waveforms, durations and times are modified not only by the transmission distance but by the media, this redundant capability assures further against accidental triggering or actuation of the remote device. Impact forces and pressures generated mechanically or transmitted from other sources through the surrounding environment thus are even less likely to affect the remote tool.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
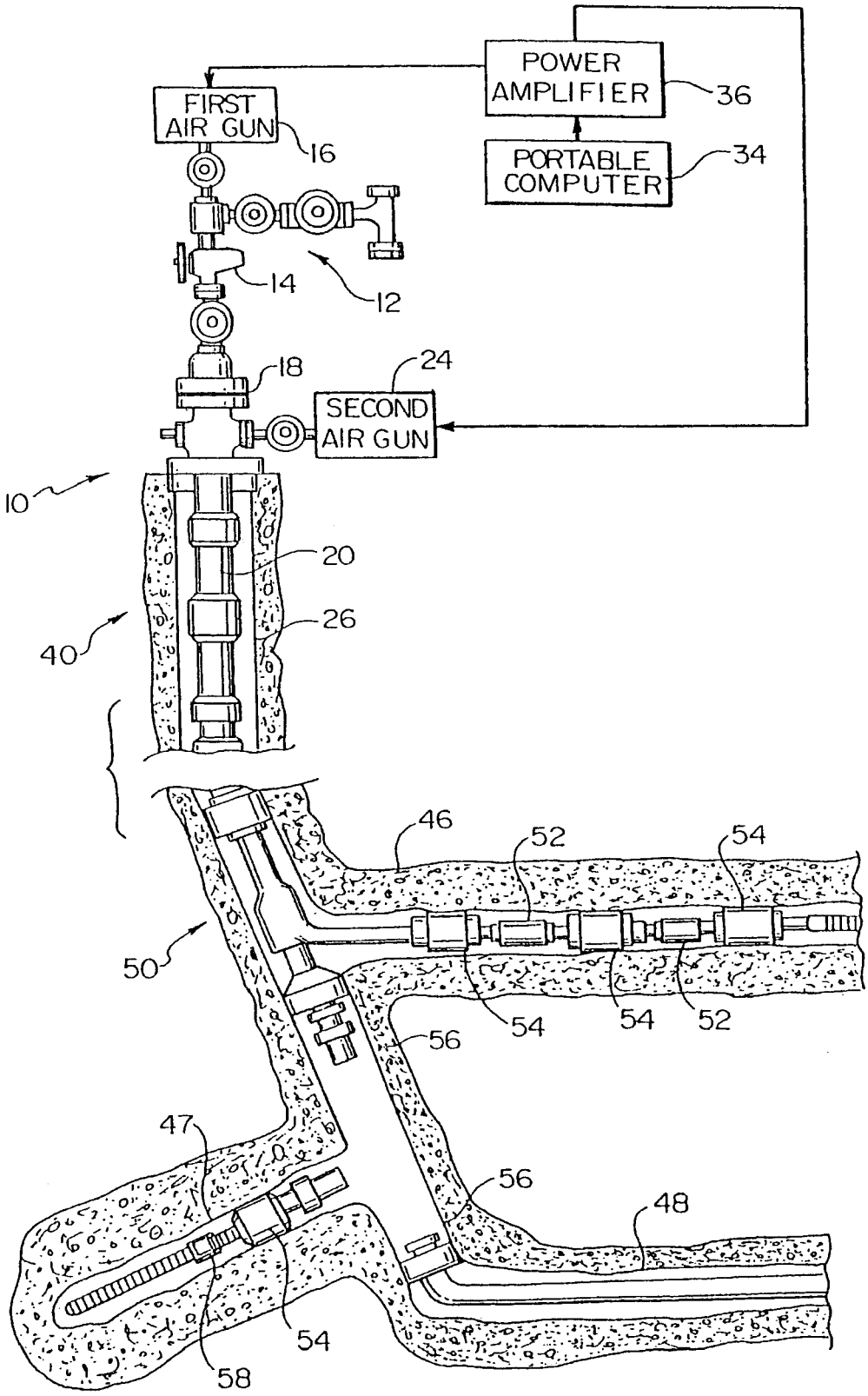
FIG. 1 is a combined block diagram and perspective view of an exemplary system in accordance with the invention.

A system and method in accordance with the invention, referring now to FIG. 1, disposes an impulse transmitting system 10 at a well head 12. At the well head connection 14, the impulse transmission system 10 includes a first air gun 16 coupled via a flange 18 into the center bore of the tubing 20 in the well. This connection can be made into any of a number of points at the wellhead, such as a crown/wing valve, a casing valve, a pump-in sub, a standpipe or and other such units. The impulse transmitting system 10 also may include, optionally or additionally, a second air gun 24 coupled at a flange into the annulus between the tubing 20 and the well casing 26.

Possible propagation paths mainly comprise the interior of the tubing and the annulus spaces, through the gas or liquid media therein. There are also, however, different acoustic signal propagating paths, such as drill pipe and casing steel, and electric or "Slickline". Each has its own pressure impulse transmission properties, including propagation rate, but pressure impulses moving along the paths will be of a lesser order of magnitude than those through the tubular bounded media.

Within the cross-sections defined by steel boundary elements, the fluid media may comprise oil, an oil-water mix (with or without gas bubbles), oil or water to a predetermined level that is below a gas cap depth, a complete gas path, a gas/foam mix, or a typical operating fluid, such as a drilling mud containing substantial particulates and other solids. These are what are termed "mobile" fluid media, since they can be transported and circulated above the down hole devices. It is desired to communicate through any such media, and the specific nature of the fluids in any particular installation will generally be known.

Figure 4:
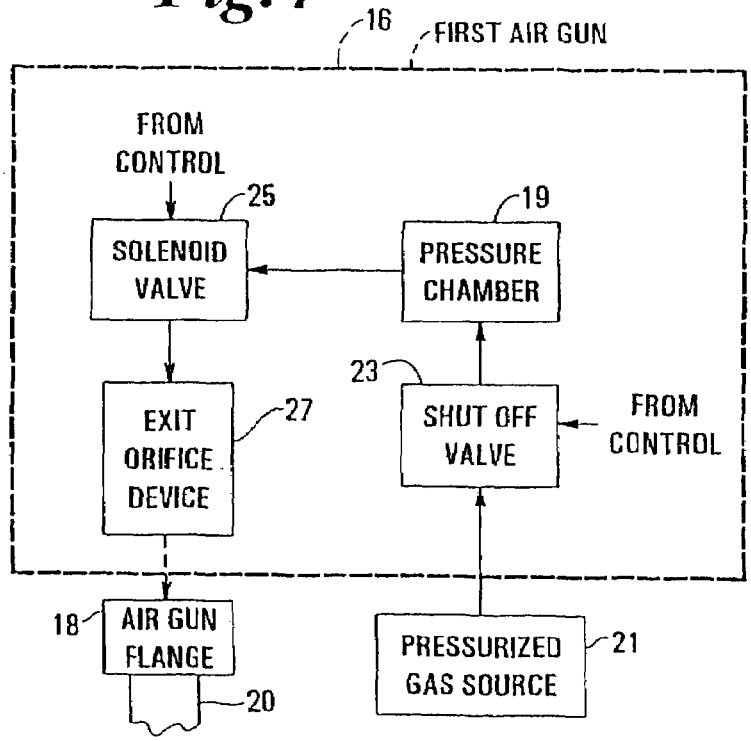
FIG. 4 is a perspective view, partially broken away, of a shock pulse generating system for use in the system of FIGS. 1 and 2.

The term "air gun" is used here to connote a shock generator for high intensity pneumatic impulses, even though some other gas than air is typically used. Compressed nitrogen and sometimes $CO_2$ is preferred, so that if mixed with a flammable source, a flammable environment is not created in or around the well. Referring now to FIG. 4, each air gun 16 or 24 includes a pressure chamber 19 which is pressurized by gas from a pressurized source 21 supplied via a shut off valve 23 which decouples the connection under control signals. The output from the chamber 19 is gated open by a fast acting solenoid control valve 25 receiving actuating pulses to deliver the highly pressurized gas from the chamber 19 through an exit orifice device 27 into the flange 18 or other coupling. The exit orifice 27 is preferably variable in size and shape to provide another control parameter for the shock impulse. The source 21 advantageously contains a commercially available inert and nonflammable gas such as nitrogen at a high pressure (from 200 to 15,000 psi). Nitrogen bottles at 2,000 psi are commonly available and will provide adequate pressure for a high proportion of applications. A higher pressure source may be used, or a gas intensifier pump and the pressure can be reduced from the maximum to a given level for a particular usage by a variable pressure regulator (not shown).

The volumetric pressure chamber 19 in the air guns 16, 24 comprises an impulse transformer, which may incorporate a movable piston wall (not shown) or other element for adjusting the interior volume. An interior volume of from 2 $in^3$ to 150 $in^3$ is found to be adequate for the present examples, although other volumes may be advantageous depending on the application. The greater the volume, the higher the energy level delivered, other factors remaining constant.

The air gun 24 is gated open within a short interval, typically a few milliseconds, by the valve 25, and provides a pulse burst of about 40 milliseconds duration with sharp leading and trailing edge transitions and highest amplitude in mid-burst. Gas flow dynamics involved in the release of high pressure momentarily from a small volume into a larger volume introduces negative going excursions both after the initial positive excursion and during a few subsequent cycles.

The output from the air gun 16 or 24 is variously referred to herein as a "pulse burst", "pressure impulse", "pneumatic impulse", "shock impulse", an "acoustic pulse" and by other terms as well, but all are intended to denote the variations occurring upon sudden injection of a pressurized gas into the system for downhole transmission.

Dependent on the pressure, chamber volume and the orifice size and shape, the shock impulse can be achieved by simply opening the valve 25 to allow the pressurized gas to expel, and closing the valve after a suitable duration to pressurize for the next impulse, or by specifically timing the opening and closing of the valve to precisely predetermine the leading and trailing edge.

Referring again to FIG. 1, control signals for generating the pneumatic impulses are initiated as outputs from a portable computer 34 and amplified via a driver amplifier 36. The computer 34 can be used to calculate the energy estimate needed for an impulse, given the well bore diameter and length, well interior volume including lateral bore holes, and known practical parameters, such as the interface location between gas and fluid media and the characteristics of the media in the well bore. From these factors and prior relevant experiments, the air gun variables can be selected. Air gun variables may include the differential pressure level at the pressurized gas source 21, the volume of the chamber 19, the open time for the solenoid valve 25, and the shape and area of the orifice device 27. The shock impulse is converted, because of gas compressibility and the dynamics of gas movement through the chamber 32 and orifice 19, into a burst having a few cycles of rapid rises and declines in amplitude to and from a peak amplitude cycle (e.g., waveforms (A) in FIGS. 5, 6 and 7).

Whether the first air gun 16 or the second air gun 24 is used will be determined by the operator, depending upon the down-hole tool to be operated, the most efficient transmission path and signal receiver position in the tubing or annulus. The well bore 40 below the well head 12 comprises typically a conventional tubing 20 and exterior casing 26 string within a cement fill. Lateral bore holes 46 and 47 which may be greater or lesser in number, extend from the well bore 40 at chosen angles of inclination. The media 65 in the well bore 40 will be an energy transmissive medium, whether gas, air, foam, water, oil, or a drilling mud, or mixtures of different kinds.

In the lower regions of the well, various remotely controlled tools are shown as used in two of the lateral bores 46, 47 that branch off from the main bore 40, which extends at its lowest elevation into a horizontal extension 48. At a selective re-entry and diverter system 50, the first lateral bore 46 diverts horizontally to a well formation such as a hydrocarbon bearing region, as seen in idealized form. Along this line 46 the tubing includes remotely controlled sliding sleeves 52, separated by external casing packers 54 to provide zonal isolation. At the second lateral bore 47, a different illustrative example is shown, in which the branch is bounded in the main bore by a pair of casing packers 56, while in the lateral bore 47 a distal remotely controlled valve 58 is isolated by an external casing packer 54. Similarly, in the main well bore, another remotely controlled valve 60 is below the lower casing packer 56. Since there may be a number of lateral bores (as many as eight have been known to have been tried), the capability for command and control of different tools and equipment in each branch at different depths requires high energy levels as well as advanced signal encoding and detection. These objectives are realized by systems and methods in accordance with the invention.

In an exemplary test system, referring now to FIG. 2, the media 65 comprised water rising to a level (~136 feet) below the well head 12, which established a gas/liquid interface 67 at the water surface, while an uppermost air gap of 136 feet remained. In addition to the media 65, of course, energy transmission paths might exist to some degree along the steel walls defined by the tubing 20 and down-hole casing 44 walls themselves. The degree to which the shock impulses are communicated into the metal is dependent upon many factors not significant here, such as the physical geometry, the impedance matching characteristics, and steel wall thickness and physical properties. The interior cross-sectional dimensions of the well bore 40 and/or the annulus about it, however, are the most significant factors in transforming the impulse energy into an extended pattern having "tube wave" components about some nominal center frequency. The other most significant factor is the characteristic of the medium along the length of the well bore 40.

Since the length of a deep well is many thousands of feet, the brief pressure energy impulse, when sufficient in amplitude, has ample residence time, when propagated along the longitudinal sections within the confining walls, to transform to a preferential frequency range. Usually this will be below about 200 Hz, typically below the 60 Hz range.

The propagation speed varies in accordance with the media characteristics along the propagation path. This speed is significantly different for different media, as follows:

| | |
|---|---|
| Air (or $CH_4$ or other gas) | 1100 fps |
| Seawater | 5500 fps |
| Oil | 5000 fps |
| Drilling mud | 5500-8000 fps |
| Steel tubing/casing | 18000 fps |

Figure 2:
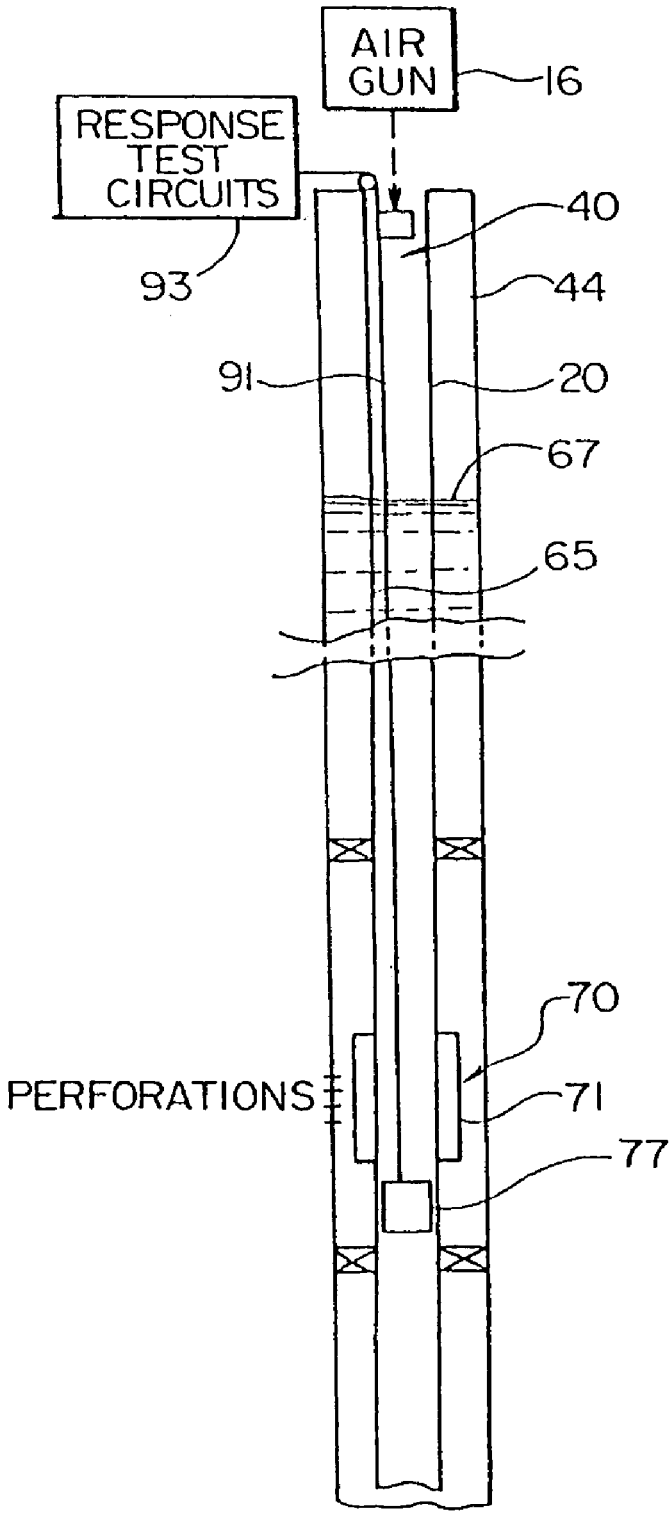
FIG. 2 is a partially diagrammatic side sectional view, simplified and foreshortened, of a test system used in a well bore installation.
Figure 3:
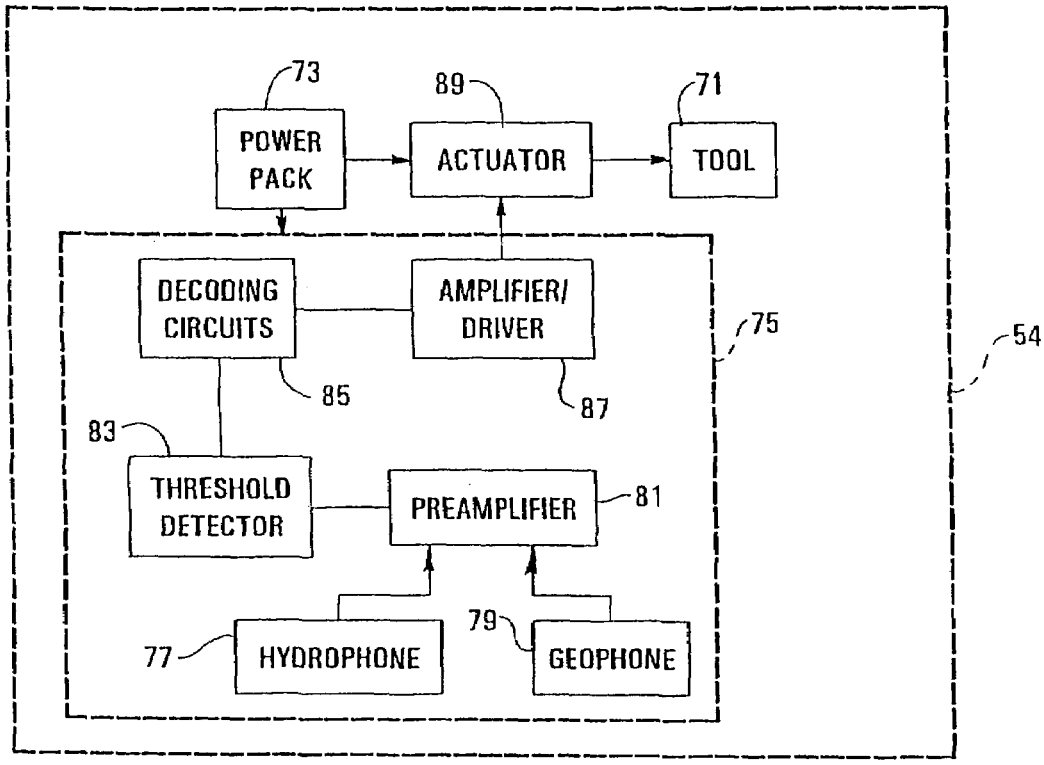
FIG. 3 is a block diagram representation of a remotely controllable tool, self-powered, for use in conjunction with a system of the type of FIGS. 1 and 2.

At one or more chosen locations in the well bore 40, or in the lateral bore holes 46 and 47, tools 70, flow controllers and other equipment, shown only generally in FIG. 2, are to be positioned at known depths and locations. The specific tool in one illustrative exemplification, referring now to FIG. 3, is a well perforating gun 71, arranged together with its own power pack 73, such as a battery. Signal detection and control circuitry 75 are also disposed at the remote tool 70, also being energized by the power pack 73. The detection and control circuitry 75 includes a hydrophone 77, which responds to pressure amplitude variations, and a geophone 79 or seismometer-type device which responds to other physical perturbations of the media resulting from shock-generated movements. Alternatively, in one practical example microphones were found to be particularly suitable for detection. The control circuitry 75 also includes pre-amplifiers 81, threshold detection circuits 83, decoding circuits 85 and amplifier/driver circuits 87. The output energizes an actuator 89 receiving power signals from the power pack 73, to trigger the well perforating gun 71 or other tool. The perturbations of the media, i.e., influences or effects in the media that may result from the impulses, may include variations in the pressure, displacement, velocity or acceleration.

Figure 5:
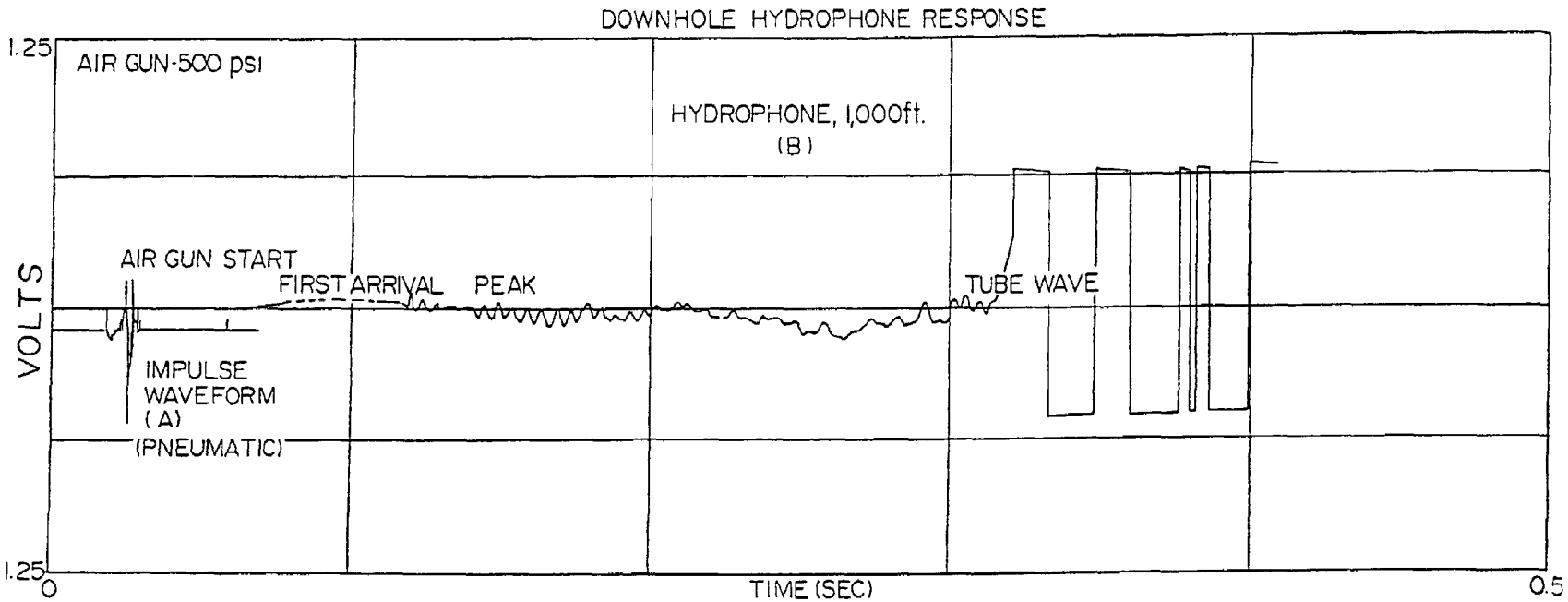
FIG. 5 is a graph of signal waveforms as transmitted and received in a first test in the test installation.
Figure 6:
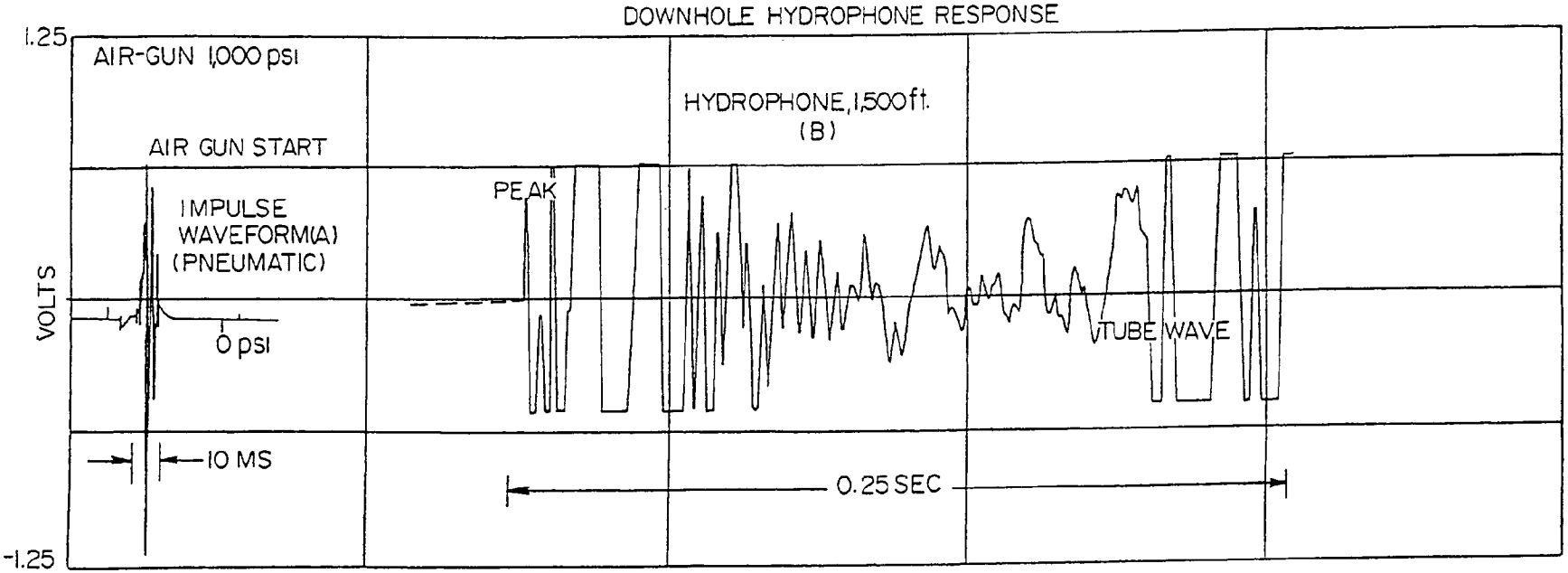
FIG. 6 is a graph of signal waveforms as detected at depth in a second test under different conditions in the test installation.
Figure 7:
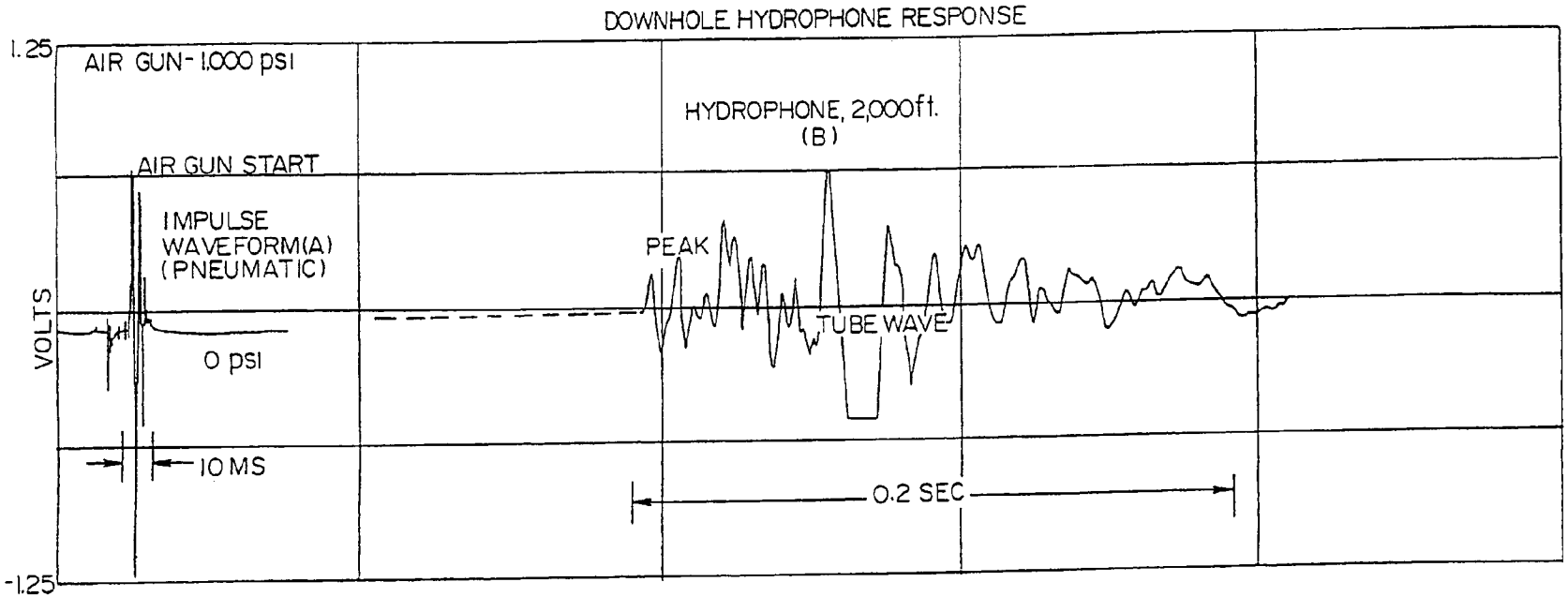
FIG. 7 is a graph of signal waveforms as detected at depth in a third test in the test installation in accordance with the invention.

At the surface, signals received at the hydrophone 77 were received via an electrical support line 91 and recorded and analyzed at response test circuits 93, enabling the charts of FIGS. 5 to 7 to be generated.

The signal detection and control circuitry 75 is configured to respond to the energy in the perturbations of the media reaching the down-hole location in a time-extended, somewhat frequency-centered form, as shown by waveforms (B) in FIGS. 5, 6 and 7. The amplitude of the wave energy bursts, as well as the time pattern in which wavetrains are received, are the controlling factors for coded signal detection. Since it is not required to detect signal energy at a particular frequency or to measure the time span of the signal, signal filtering need not be used in most cases. However, if ambient noise is a consideration when higher frequency components are present, then low frequency band pass can be used. Tube waves have been measured to be in the range of below about 50 Hz, so an upper cutoff limit of the order of 200 Hz will suffice for such conditions. Moreover, conventional signal processing techniques can be utilized to integrate the signals received, thus providing even greater reliability.

The different pressure variation detectors that are shown or referred to, namely the hydrophone 77, the geophone 79, a microphone and an accelerometer, are usually not needed at the same time for an adequate signal-to-noise ratio. However, since the nature of the modulation and attenuation introduced during transmission of the shock impulse from the well head 12 cannot be exactly known, there is some benefit to be derived from utilizing confirmatory readings. A second detector or a third detector can be used simultaneously together with signal verification or conditioning circuits, to enhance reliability. If both the pressure amplitude variation from the hydrophone 77 and the wave velocity variation represented by the output of the seismic-type detector 79 (geophone or accelerometer) are consistent, then the shock impulse gun signal has been even more assuredly identified than if a single transducer alone is used.

In a preferred embodiment, the encoded signal pattern that is generated at the air gun 16 or 24 for remote detection and control is usually in a format based on a binary sequence, repeated a number of times. Each binary value is represented by a burst (e.g., binary "1"), or non-burst (e.g., binary "0"), during a time window. Thus, if a binary sequence of 1,0,0, 0,1 is used to designate a particular remote tool 70, then there will be impulse bursts only in the first and fifth time windows.

The preprogramming of different remote tools or equipment can be based on use of a number of different available variables. This flexibility may often be needed for multilateral wells, where a single vertical well is branched out in different directions at different depths to access adjacent oil bearing sands. Here, the use of paired different signal transducers enables more reliable detection of lower amplitude signal levels.

Moreover, the signal patterns can employ a number of variables based on pressure, time, chamber volume and orifice configuration to enable more code combinations to become available. For example, using a pressure regulated source, the starting impulse can be given varying waveforms by changing pressure (e.g., from 2,000 psi to 3,250 psi) using the same chamber size. The stored pattern of the remote microprocessor will have been coded to detect the changed signal waveforms. Likewise, chamber volume can also be varied within a signal sequence to provide predictable modulation of downhole wavetrains.

In a preferred embodiment, the time gap between the time windows in the first example is determined by the duration needed to establish non-overlapping "sensing windows" at the remotely controlled device, as seen in FIG. 8(A). As the shock impulse travels along the well bore 40, energy components in the media 50 will be more slowly propagated than energy components moving along the tubing 20 or casing 26. The sensing windows, and therefore the initiating time windows, are, however, spaced enough in time for propagation and reception of the slowest of the received signal sequences, without overlap of any part of the signals with the next adjacent signal in the sequence.

In other words, after one burst has been generated at the well head, sufficient time elapses as that burst is propagated down the well bore 40 for another burst to be generated while the first is still en route. Once a first wavetrain has been received, the remaining sensing windows can be timed to start at reasonable times prior to the anticipated first arrival of the succeeding propagated wavetrains. However, until the first wavetrain is received, the receiving circuits operate as with an indefinitely open window.

Figure 8:
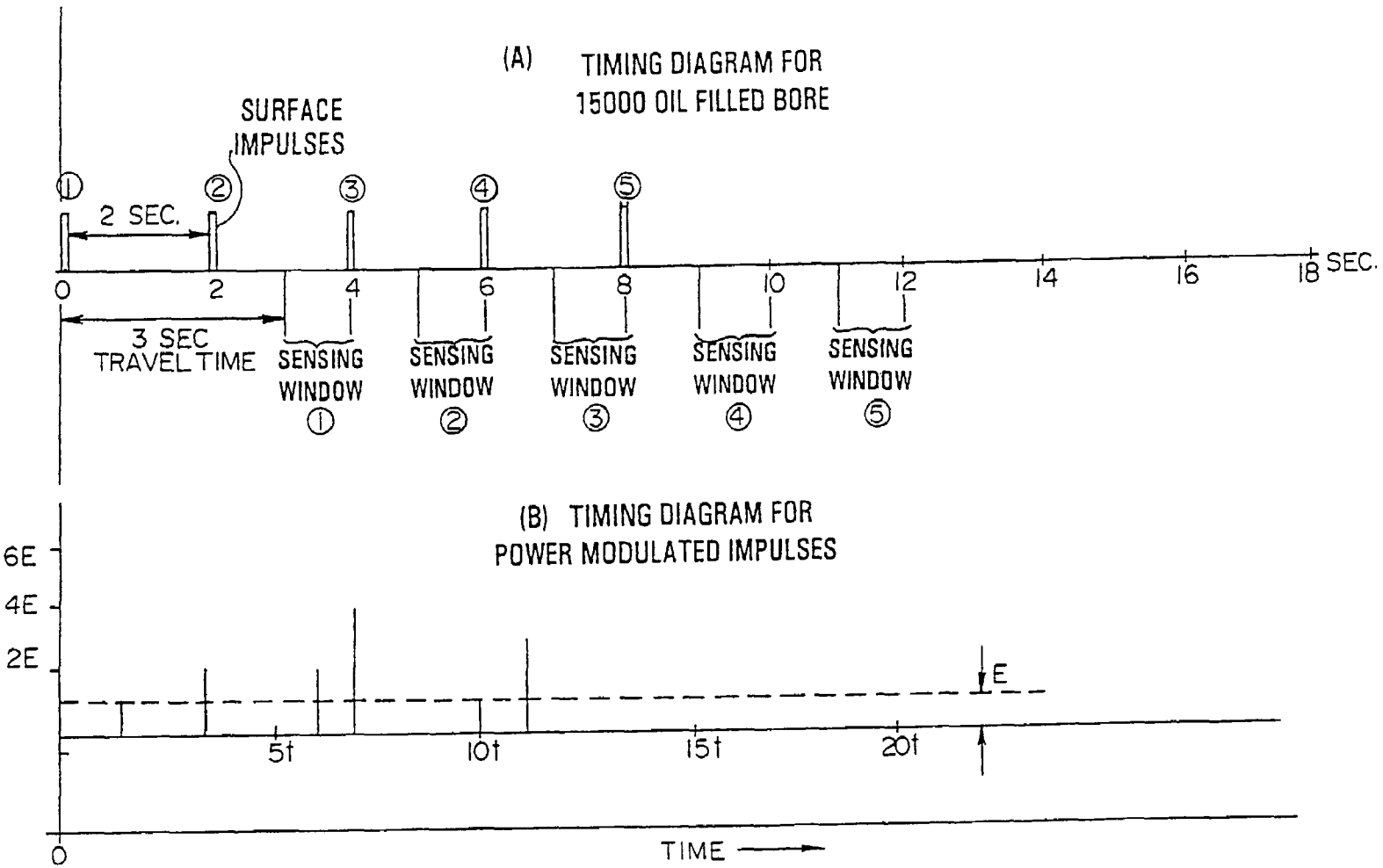
FIG. 8 is a graphical representation of timing relationships observed in a system in accordance with the invention.

Another variant, shown at waveform B in FIG. 8, incorporates the aforementioned technique of modulating signal power in the impulses in a sequence, while also maintaining time separation between them to avoid noise and interference. In FIG. 8(B), the impulses are always separated by a time (t) adequate to avoid noise and overlap interference. The absence of a pulse in a given time cell, of course, also can represent a binary value. Furthermore, the pulse energy can be varied by multiples of some base threshold (E) which is of sufficient amplitude for positive detection not only of minimum values but the incrementally higher values as well.

These timing relationships as depicted in FIG. 8 are somewhat idealized for clarity. Once the time-distributed code wavetrain is received, a triggering pulse from the decoding circuits 85 (FIG. 3) through the amplifier/driver circuit 87 impulses the actuator 89, initiating the perforating gun 71 operation. However, before triggering the tool, the code input is repeated a predetermined number of times, including at higher or lower air gun pressures and chamber volumes as selected, further to ensure against accidental operation. A typical example of a system, for a 15,000 foot deep well bore, can provide in excess of 16, but fewer than 32, remotely operable tools. For this number of tools, 32 ($2^5$) binary combinations are sufficient, meaning that the coded signals can comprise repeated patterns of five binary digits each if impulses of equal energy are used. Fewer impulses are needed if amplitude modulation is used as well.

FIGS. 5-7 illustrate transmission and detection in a test well such as shown in FIG. 2, under different conditions, but all having an air gap of approximately 136 feet interfacing with a much greater depth of water below. The sensitivity of commercially available hydrophones is such that, given the energy and characteristics of a shock impulse in accordance with the invention, a signal level of high amplitude and adequate signal to noise ratio can be derived at a deep well site. A pressure fluctuation of 1 psi generates a 20 volt output so that, for example, if the pressure variation is an order of magnitude less (0.1 psi), the signal generated is still 2 volts, which with modern electronics constitutes a very high amplitude transition.

The sensitivity of a modern commercial geophone in response to velocity variations is also high, even though less in absolute terms, being typically in the order of 20 volt-in./sec. or 0.2V for a wave of 0.1 in./sec.

Consequently, a brief shock impulse, time distributed over a longer interval and converted to a "tube wave" is readily detected at a deep sub-surface location. This is true even though waves are much more efficiently transmitted in pure liquid than in a gas, which is compressible, or in a mud, which contains reflective particulates.

In the example of FIG. 5, the shock impulse was derived from a pressurized $CO_2$ source directed through a 3 $in^3$ chamber and suspended at a depth of approximately 11 feet below the surface of the well bore. The shock impulse (wave form A) and at a given pressure was converted to the hydrophone outputs at the depths indicated. (Note that the shock impulse is not on the same scale as the detected electrical signal.) Typically, the higher amplitude half cycles of the shock impulse were at such levels that the detected signals were amplitude limited (i.e., "clipped") on the recorded pattern because they exceeded the recording limit of the receiving mechanism. The clipping level was at about 0.6 volts. The interface level 67 in FIG. 2 was 136 feet below the surface in a 5 inch well bore.

Referring to FIG. 5, in which the air gun pressure was at 500 psi and the hydrophone at 1,000 feet, it can be seen that the impulse burst was at substantial amplitude for a duration of the order of 10 milliseconds, starting about 25 milliseconds from zero time on the graph. Transmission through the well bore substantially extended the time duration of the impulse, into a preliminary phase after first arrival that lasted for 0.2 seconds before the high amplitude tube wave was detected.

The example of FIG. 6, in which the air gun was at a 1,000 psi pressure, and the hydrophone at 1,500 feet, generated an input, acoustic shock wave of substantially greater input amplitude. The "first arrival" time elapsed is, however, shown only as a dotted line and the time base is unspecified because although the waveforms are correct, the processing circuits did not adequately delineate the time delay before first arrival. Nonetheless, the "tube waves" occurring over extended time spans in response to the input impulse peaks reached the hydrophone and generated the waveform shown, with each vertical division representing a 0.1 second interval (except as to first time arrival).

The impulse burst (A) in FIG. 7 was again generated with the air gun at 1,000 psi pressure so that the impulse profile corresponded to that of FIG. 6. The time before first arrival was again not precisely ascertainable but the detected waveform thereafter is correct. The detected amplitude at 2,000 feet diminished from that detected at 1,500 feet, but still was of the order of one volt. This again illustrates the principle that, given that multivolt signals can be accurately detected, there is adequate energy for deep-hole locations.

Accordingly, dependent upon both the depth and the media through which acoustic impulses are to be transmitted, the energy level impulsed by the air gun can be substantially increased by higher pressure and higher chamber size so as to provide reliable distribution through a deep well system. Orifice size and shape can also be used to vary the impulse characteristics.

For an exemplary 15,000 foot depth, filled with liquid hydrocarbons, each binary code combination requires a time window (and a corresponding sensing window) of approximately 1.0 seconds, assuming a minimum propagation time of 3.0 seconds. With respect to the timing diagram of FIG. 8, a difference, or time window, of 2 seconds between surface impulses readily avoids overlaps at the remote location. When providing five total successive binary sequences in this fashion, while adding an extra interval to distinguish the different binary sequences, the total actual testing interval is only of the order of 2.5 minutes. This is virtually the entire amount of operating time required if air guns are preinstalled. Added time would be needed to set up air gun connections at the well head, but if flange couplings and shutoff valves have been provided, the couplings can be made without delay.

Using commercial hydrophones and geophones, useful outputs are derived under deep well conditions. In the test installation, the hydrophone output is approximately 2 volts and the geophones output is 0.2 volts, each of which readily facilitates signal detection.

Figure 9:
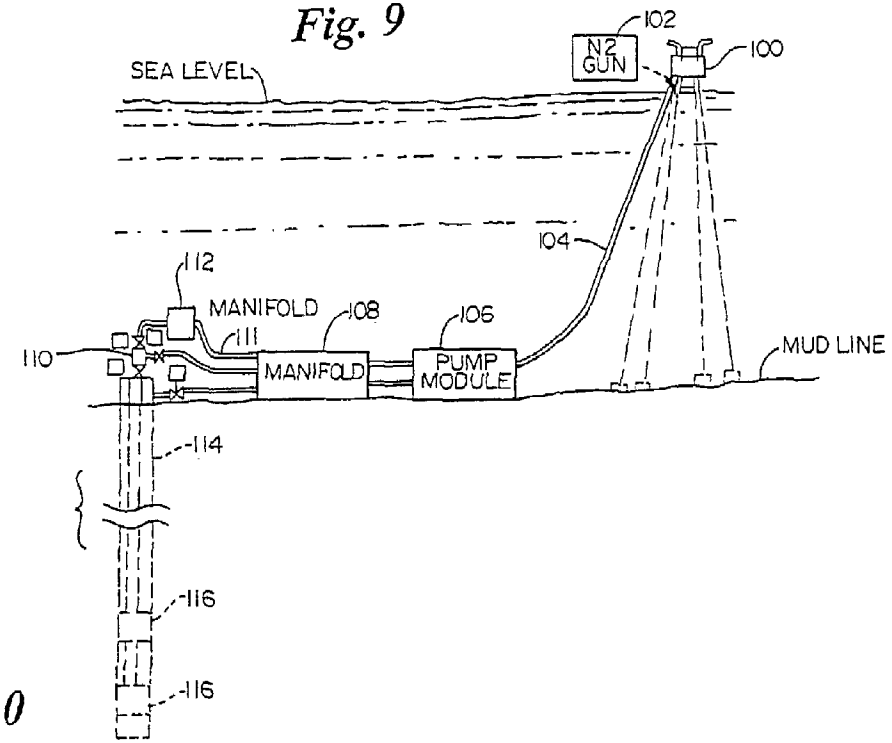
FIG. 9 is a simplified example of a system in accordance with the invention as used in a subsea installation.

As illustrated in FIG. 9, to which reference is now made, the remote control system and method are applicable to subsea applications in a variety of forms. A platform 100 of the floating or seafloor mounted type, supports an $N_2$ gun 102 coupled at or near the apex of a gathering pipeline 104. Mounted on the sea floor are a pump module 106 coupled to the gathering pipeline 104, and a manifold 108 in communication with a crown valve 110 via a tubing 111 which includes a manifold jumper valve 112. The crown valve 110 and the manifold jumper valve 112 may be controlled by a hydraulic system, or remotely by pressure impulses, in the manner previously described. When opened, however, these elements provide a communication link for transmission of pressure impulse signals into a subsea well 114 in which down-hole tools 116 are positioned. These may be sleeves, valves and various other tools in the main well bore or in multi lateral branches.

As previously described, complex pressure impulse signal patterns can both address and actuate subunits on the sea floor as well as down-hole tools. The sea floor systems include not only the subsea manifold 108 and the pump 106, but subsea separation processing modules and subsea well controls. The control system can alternatively be a secondary control for subsea trees and modules, where the primary control system is most often a combination of electric communication and hydraulic actuation units.

In the development of production systems, there has been a trend toward replacing platforms with floating vessels for production, storage and off-loading applications. Such vessels can process the flow to reduce water and gas content and then deliver the product to shuttle tankers or on-shore locations. Again, subsea modules including manifolds, valving systems and pumps, can control operations and flows from a number of different well bores. In these applications, remote control of units, tools and other equipment on the sea floor or in the well bores can be extremely useful for deep water subsea completions.

Figure 10:
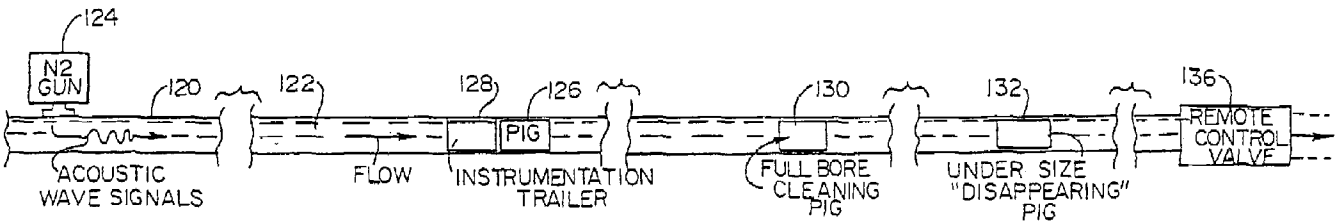
FIG. 10 is a simplified example of a system in accordance with the invention for a pipeline application.

Whether a pipeline is on the surface or buried, or a combination of these placements, an ability to command and control remotely can be very useful, and the shock impulse control mode, system and method, are applicable for a variety of unique purposes in the pipeline installation. A pipeline 120, referring now to FIG. 10, which may extend for a long distance, incorporates an $N_2$ gun 124 and associated control system at predetermined positions along the pipeline length, for example, attached to pig trap valving or near pumping stations. FIG. 10 illustrates a number of separate remote control applications, even though these will typically not co-exist, although they can possibly do so.

Pipeline pigs, for example, are widely used for inspection of pipeline sections. For this purpose, a pig 126 having an instrumentation trailer 128 and sized to mate in sliding relation within the pipeline 120 is transported along the pipeline under pressure from the internal flowing media 122. A self-contained power supply and control circuits on the pig 126 and/or the instrumentation trailer 128 can be actuated by encoded signals from the $N_2$ gun 124, whatever the position along the pipeline length, since the media 122 provides excellent acoustic signal transmission. The pig 126 can be commanded to stop by expansion of peripheral members against the interior wall of the pipeline 120, so that the instrumentation trailer 128 can conduct a stationery inspection using magnetization, for example. If the inspection can be done while in motion, the instrumentation trailer 128 is simply commanded to operate.

Alternatively, expandable pigs having internal power supplies and control circuitry can be immobilized at spaced apart positions upstream and downstream of a leak, so that a repair procedure can be carried out, following which the pigs can be commanded to deflate and move downstream to some removal point.

It is now common to transport cleaning pigs along the interior of a pipeline, with the pigs sized to scrape scale and accumulated deep debris off the interior pipeline wall. Such a pig 130 may become stuck, in which event shock impulse control signals may be transmitted to actuate internal mechanisms which impart thrust so as to effect release, or reduce the pig diameter in some way such as by detonators. Such cleaning pigs 130 are also constructed so as to disintegrate with time, which action can be accelerated by strong shock impulse triggering signals actuating an internal explosive charge.

This is one type of "disappearing pig" for cleaning applications, known as the "full bore" type. However, undersized pigs 132, usually of polyurethane, are also run through a pipeline with the anticipation that they will not get stuck by scale or debris. If they do get stuck, such an undersized pig 132 gradually dissolves with pressure and time, although this action can be greatly accelerated by the use of the remote control signals.

In a number of applications required for pipeline operation, such as dewatering, it is desirable to be able to control a remote unit, such as a check valve. Here again, the high energy encoded signals can be used efficiently, since they can transmit a detectable signal for miles within the pipeline 120, to be received by a remote control valve 136, for example.

Although a number of different applications have been illustrated and identified for high impulse signal control of remote tools and other equipment, many other applications are possible. For example, hydraulic pressure-operated tools employed in drill stem testing and tubing conveyed perforating operations can advantageously be supplanted by acoustic actuation, thus minimizing the possibilities of accidental actuation of pressure-operated elements. Rapid sequencing control for "OMNI" valves can be accomplished more rapidly and reliably using acoustic control signals. In GP screen isolation tubing, flapper valves or sleeves can be efficiently operated. A number of other applications will suggest themselves to those skilled in the art.

While various forms and variations in accordance with the invention have been described it will be appreciated that the invention is not limited thereto but encompasses all the alternatives and variations in accordance with the appended claims.

What is claimed:

1. An actuator for propagating an impulse shock of controlled energy into an energy confinement structure extending along a substantial length, to deliver an actuating impulse to a remote location within the structure comprising:

a pressure vessel for storing a pressurized gas;

a variable volume gas chamber in controlled communication with the pressure vessel, the chamber having a volume and pressure that are selectively variable within a range;

a flow control valve in communication with the chamber, and coupled to release gas pressure therefrom;

means defining an outlet orifice coupled to said flow control valve for emitting the released gas pressure in a selected propagation direction; and triggering means coupled to the flow control valve for controlling the impulsed release of gas for a selected duration from the chamber, the duration being of the order of milliseconds, whereby the energy of the pulse shock can be adjusted in correspondence to the chamber volume and the duration of the impulse.

2. An actuator for propagating an impulse shock into an energy confinement structure extending along a substantial length, comprising:

a pressure vessel for storing a pressurized gas;

a variable volume gas chamber comprising a cylinder and an interior variably positionable piston, the chamber being in controlled communication with the pressure vessel, and having a selectively variable volume;

a flow control valve in communication with the chamber, and coupled to release gas pressure therefrom;

means defining an outlet orifice variable in outlet size and shape coupled to said flow control valve for emitting the released gas pressure in a selected propagation direction; and triggering means coupled to the valve member and comprising a non-electrical device from the class comprising mechanical, pneumatic and hydraulic devices for controlled release of gas for a selected duration from the chamber.

3. A gas gun system for delivering shock impulses of identifiable durations to downhole locations in a wellbore installation to individually activate downhole tools which may be at different distances from the air gun system and in which the media may have different shock characteristics, comprising:

a pressure gas source;

a gas chamber having an internal volume that is selectively variable within a range;

a controllable shut-off valve intercoupling the gas source to the gas chamber;

an exit orifice device coupled to the wellbore installation and delivering gas impulse shocks from flows provided from the variable volume gas chamber;

a fast acting flow valve responsive to triggering signals and coupled to supply pressurized gas when open from the gas chamber to the exit orifice device; and a trigger device coupled to open the flow valve for durations in the millisecond range, such that adequate energy can be delivered to at least one selected downhole tool by selection of the duration of the pressurized gas impulse and the volume of the gas chamber.

* * * * *